US007345648B2

(12) United States Patent
Noro et al.

(10) Patent No.: US 7,345,648 B2
(45) Date of Patent: Mar. 18, 2008

(54) ANTENNA UNIT

(75) Inventors: Junichi Noro, Akita (JP); Takao Kato, Akita (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 87 days.

(21) Appl. No.: 11/318,411

(22) Filed: Dec. 22, 2005

(65) Prior Publication Data

US 2006/0202904 A1 Sep. 14, 2006

(30) Foreign Application Priority Data

Mar. 10, 2005 (JP) ..... 2005-067073

(51) Int. Cl.
*H01Q 1/36* (2006.01)
*H01Q 1/42* (2006.01)

(52) U.S. Cl. ..... 343/895; 343/872; 343/789; 343/906

(58) Field of Classification Search ..... 343/895, 343/906
See application file for complete search history.

(56) References Cited

U.S. PATENT DOCUMENTS 5,357,261 A * 10/1994 Brandigampola ..... 343/900
5,838,285 A 11/1998 Tay et al.
6,150,984 A * 11/2000 Suguro et al. ..... 343/702
6,278,414 B1 8/2001 Filipovic
6,339,408 B1 1/2002 Edvardsson et al.
6,429,830 B2 8/2002 Noro et al.
6,433,755 B1 8/2002 Kuramoto
6,587,081 B2 * 7/2003 Noro et al. ..... 343/895
6,628,241 B1 * 9/2003 Fukushima et al. ..... 343/895
6,642,893 B1 11/2003 Herbron et al.
6,784,850 B2 8/2004 Morooka et al.
6,919,859 B2 * 7/2005 McCarthy et al. ..... 343/895
2002/0018026 A1 * 2/2002 Noro ..... 343/895
2006/0022891 A1 * 2/2006 O'Neill et al. ..... 343/895
2006/0202901 A1 9/2006 Noro et al.
2006/0202902 A1 9/2006 Noro et al.
2006/0202903 A1 9/2006 Noro et al.

(Continued)

FOREIGN PATENT DOCUMENTS

JP 2001-339227 A 12/2001

(Continued)

OTHER PUBLICATIONS

Related U.S. Appl. No. 11/318,409, filed Dec. 22, 2005; Inventor: J. Noro et al.

(Continued)

*Primary Examiner*—Trinh Vo Dinh
(74) *Attorney, Agent, or Firm*—Frishauf, Holtz, Goodman & Chick, P.C.

(57) ABSTRACT

An antenna unit comprises a hollow cylindrical member obtained by forming a flexible insulating film member into a hollow cylinder and an antenna pattern composed of a plurality of conductors formed on a peripheral surface of said hollow cylindrical member. A phase shifter pattern is formed on the peripheral surface of the hollow cylindrical member so as to be electrically connected to the antenna pattern. The antenna unit further comprises a hollow cylindrical cover case covering the hollow cylindrical member and a characteristic adjusting member for adjusting an antenna frequency characteristic.

11 Claims, 13 Drawing Sheets

U.S. PATENT DOCUMENTS

2007/0018905 A1* 1/2007 Kato et al. ..... 343/906

FOREIGN PATENT DOCUMENTS

JP 2001-339228 A 12/2001
JP 2003-037430 A 2/2003

OTHER PUBLICATIONS

Related U.S. Appl. No. 11/318,408, filed Dec. 22, 2005; Inventor: J. Noro et al.
Related U.S. Appl. No. 11/318,407, filed Dec. 22, 2005; Inventor: J. Noro et al.

* cited by examiner

ANTENNA UNIT

This application claims priority to prior Japanese patent application JP 2005-67073, the disclosure of which is incorporated herein by reference.

BACKGROUND OF THE INVENTION

This invention relates to a pole-type antenna unit and, in particular, to a pole-type and personal-type miniature antenna unit for a digital radio receiver for receiving an electric wave from an artificial satellite (that may be called a "satellite wave") or an electric wave on the ground (that may be called a "terrestrial wave") to listen in a digital radio broadcasting.

In recent years, a digital radio receiver, which receives the satellite wave or the terrestrial wave to listen the digital radio broadcasting, has been developed and is put to practical use in the United States of America. The digital radio receiver is generally mounted on a mobile station, such as an automobile, and can receive an electric wave having a frequency of about 2.3 gigahertz (GHz) to listen in a radio broadcasting. That is, the digital radio receiver is a radio receiver which can listen in a mobile broadcasting. Inasmuch as the received wave has the frequency of about 2.3 GHz, a reception wavelength (resonance frequency) $\lambda$ thereof is equal to about 128.3 mm. In addition, the terrestrial wave is an electric wave in which a signal where the satellite wave is received in an earth station is frequency shifted a little and is retransmitted in a linearly polarized wave. That is, the satellite wave is a circularly polarized wave, while the terrestrial wave is the linearly polarized wave.

As described above, since the electric wave having the frequency of about 2.3 GHz is used in the digital radio broadcasting, an antenna unit for receiving such an electric wave should be installed outdoors.

As digital radio receivers, there are a type adapted to be mounted in an automobile, a type adapted to be installed in a house or the like, and a type that is portable using a battery as a power source.

As a specific example of the portable digital radio receiver, there is available a portable electronic device such as a portable sound device. This portable electronic device comprises, in addition to a digital tuner for listening to the digital radio broadcasting, for example, an optical disk drive for reproducing an optical disk such as a compact disk (CD), an amplifier, and a speaker, which are integrally incorporated in a case.

On the other hand, there have been proposed antennas with various structures that are adapted to receive the electric wave having the frequency of about 2.3 GHz. Based on the shapes, they are roughly classified into a planar type (plate type) such as a patch antenna and a cylindrical type such as a loop antenna or a helical antenna. Such an antenna of the planar or cylindrical type is prepared as a separate member from the case of the foregoing portable electronic device and is connected to the digital radio tuner incorporated in the case through a cable and a connector so as to be used.

Generally, the antennas of the cylindrical type are more used than the antennas of the planar type because a wider directivity can be achieved by making the shape of the antenna cylindrical.

Now, description will be made about a helical antenna being one of the antennas of the cylindrical type (see, e.g. Japanese Unexamined Patent Application Publication (JP-A) No. 2001-339227). The helical antenna has a structure in which at least one conductor is wound around a hollow or solid cylindrical (hereinafter collectively referred to as "cylindrical") member in a helical (spiral) fashion. The helical antenna can efficiently receive the foregoing circularly polarized wave. Accordingly, the helical antenna is used exclusively for receiving the satellite wave. The cylindrical member is made of an insulating material such as plastic. A plurality of conductors, for example, four conductors, are generally used for improving reception sensitivity. On the other hand, it is actually quite difficult to wind the plurality of conductors around the cylindrical member in the helical fashion. In view of this, it has been proposed to produce a flexible insulating film member having one surface printed with an antenna pattern composed of a plurality of conductors (hereinafter referred to as an "insulating film member with antenna pattern") and then roll the insulating film member with antenna pattern into a hollow cylinder such that the foregoing one surface becomes an outer peripheral surface, thereby manufacturing a helical antenna (see, e.g. Japanese Unexamined Patent Application Publication (JP-A) No. 2003-37430).

In the case of the helical antenna having the structure in which the plurality of conductors are wound around the cylindrical member in the helical fashion, after a satellite wave (circularly polarized wave) is received by the plurality of helical conductors as a plurality of received waves, the received waves are phase-shifted by a phase shifter so as to be matched (adjusted) in phase, thereby obtaining a combined wave, and then the combined wave is amplified by a low-noise amplifier (LNA) and sent to a receiver. Herein, a combination of the helical antenna, the phase shifter, and the low-noise amplifier is called an antenna unit.

On the other hand, there has also been proposed an antenna unit comprising a helical antenna in the form of an antenna pattern formed on an outer peripheral surface of a cylindrical member, and a phase shifter in the form of a phase shifter pattern formed on the outer peripheral surface of the cylindrical member so as to be continuous with (connected to) the antenna pattern (see, e.g. Japanese Unexamined Patent Application Publication (JP-A) No. 2001-339228).

Such an antenna unit is placed in a topped hollow cylindrical cover case (cylinder) in order to prevent water invasion. Accordingly, the external appearance of the overall antenna unit exhibits a pole shape. In view of this, the antenna unit having such external appearance is called a pole-type antenna unit. Since the pole-type antenna unit is used while being carried, i.e. clipped to a pocket or the like, it is disposed in close proximity to the human body.

At any rate, the conventional pole-type antenna unit has the structure in which the antenna pattern and the phase shifter pattern are formed on the outer peripheral surface of the cylindrical member.

In the conventional pole-type antenna unit, there is a tendency that the distance between the cylindrical member formed with the antenna pattern and the cover case is shortened because of miniaturization. As a result, variation in assembly of the pole-type antenna unit directly exerts an influence upon antenna characteristics (antenna frequency characteristics and antenna directivity). Therefore, there is a demand for a method adapted to stabilize the antenna characteristics.

SUMMARY OF THE INVENTION

It is therefore an object of this invention to provide a pole-type antenna unit that can stabilize antenna characteristics.

It is another object of this invention to provide a pole-type antenna unit that can adjust antenna frequency characteristics.

It is still another object of this invention to provide a pole-type antenna unit that can suppress variation in antenna directivity.

According to a first aspect of the present invention, an antenna unit comprises a hollow cylindrical member obtained by forming a flexible insulating film member into a hollow cylinder. An antenna pattern composed of at least one conductor is formed on a peripheral surface of the hollow cylindrical member. The antenna unit further comprises a hollow cylindrical cover case covering the hollow cylindrical member and a characteristic adjusting member for adjusting an antenna frequency characteristic.

In the antenna unit according to the first aspect, it is preferable that the predetermined portion is the vicinity of a tip end of the hollow cylindrical member.

According to a second aspect of the present invention, an antenna unit comprises a hollow cylindrical member obtained by forming a flexible insulating film member into a hollow cylinder. An antenna pattern composed of a plurality of conductors is formed on a peripheral surface of the hollow cylindrical member. A phase shifter pattern is formed on the peripheral surface of the hollow cylindrical member so as to be electrically connected to the antenna pattern. The antenna unit further comprises a hollow cylindrical cover case covering the hollow cylindrical member and a characteristic adjusting member for adjusting an antenna frequency characteristic.

In the antenna unit according to the first and second aspects, the characteristic adjusting member may comprise an annular cushion member wound around an outer peripheral surface of the hollow cylindrical member at its tip end.

In the antenna unit according to the first and second aspects, it is preferable that the antenna unit further comprises a distance holding member for holding constant a distance between the hollow cylindrical member and an inner wall of the cover case.

In the antenna unit according to the first and second aspects, the distance holding member may comprise an annular cushion member wound around an outer peripheral surface of the hollow cylindrical member at a predetermined portion thereof.

In the antenna unit according to the second aspect, it is preferable that the predetermined portion is the vicinity of a tip end, where the antenna pattern is formed, of the hollow cylindrical member. Alternatively, the predetermined portion may be a portion, where the phase shifter pattern is formed, of the hollow cylindrical member.

In the antenna unit according to the first and second aspects, it is preferable that a thickness of the annular cushion member is slightly greater than a distance between the hollow cylindrical member and the inner wall of the cover case.

BRIEF DESCRIPTION OF THE DRAWINGS

FIGS. 2A and 2B are developed views each of a helical antenna portion and a phase shifter portion used in the pole-type antenna unit illustrated in FIG. 1, wherein FIG. 2A is a plan view showing a first surface (inner peripheral surface) and FIG. 2B is a plan view showing a second surface (outer peripheral surface);

FIGS. 7A, 7B, and 7C are diagrams showing a packing used in the pole-type antenna unit illustrated in FIG. 1, wherein FIG. 7A is a front view, FIG. 7B is a plan view, and FIG. 7C is a sectional view taken along line B-B in FIG. 7B;

DESCRIPTION OF THE PREFERRED EMBODIMENTS

Now, an embodiment of this invention will be described in detail with reference to the drawings.

Figure 1:
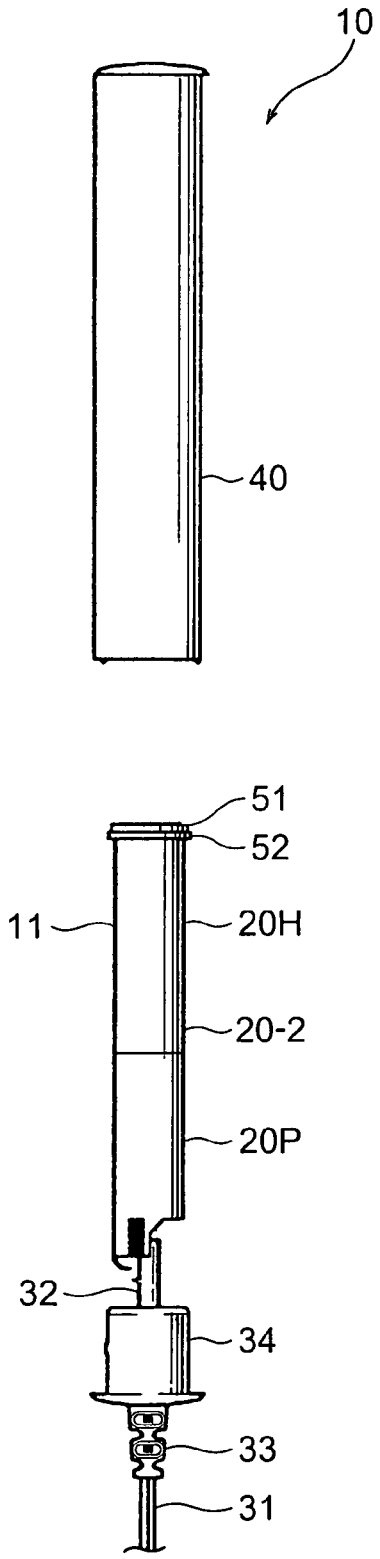
FIG. 1 is a schematic exploded front view showing a pole-type antenna unit according to an embodiment of this invention.
Figure 2B:
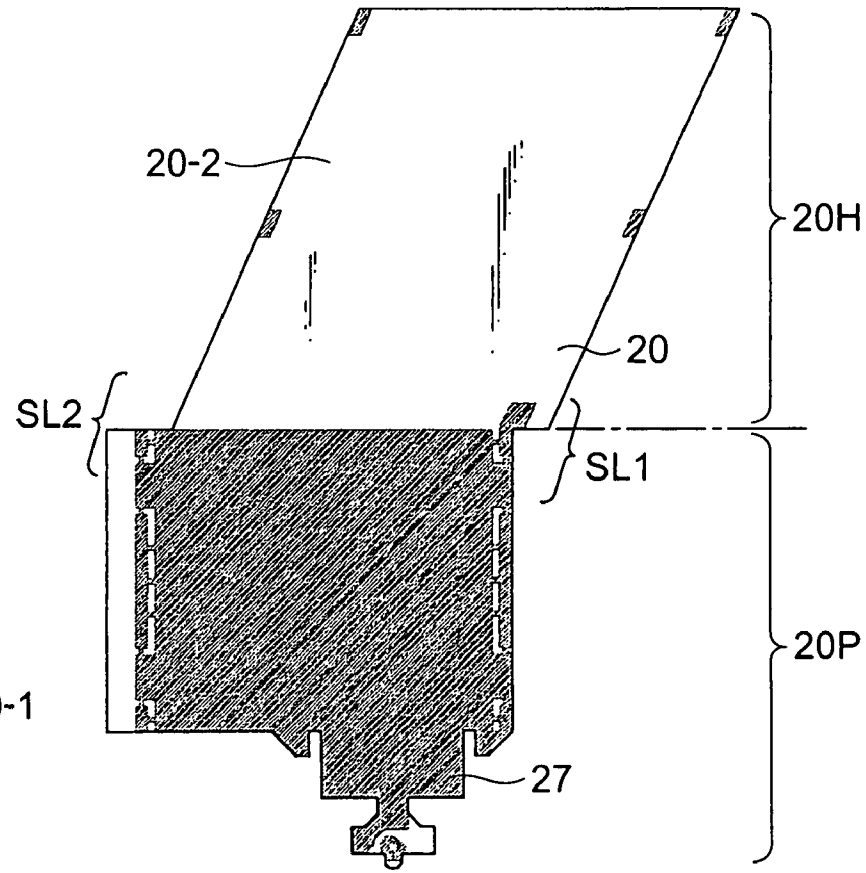
Figure 2A:
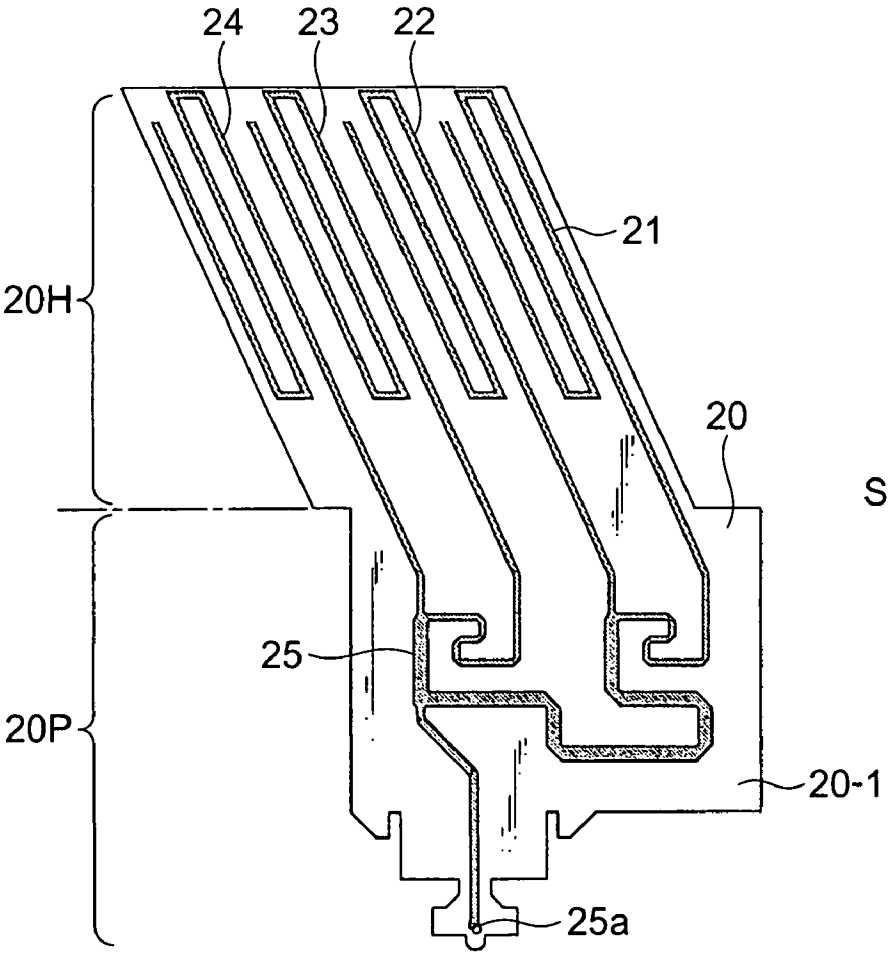

Referring to FIG. 1 and FIGS. 2A and 2B, description will be made about a pole-type antenna unit 10 according to the embodiment of this invention. The pole-type antenna unit 10 is an antenna unit for a digital radio receiver and is connected to a digital radio tuner (not shown) incorporated in a housing of a portable electronic device (not shown) through a cable 31 and a connector (not shown) so as to be used.

The pole-type antenna unit 10 comprises a hollow cylindrical member 11 formed by rolling a flexible insulating film member 20 as shown in FIGS. 2A and 2B into a hollow cylinder. FIG. 2A shows a first surface 20-1 of the insulating film member 20 while FIG. 2B shows a second surface 20-2 of the insulating film member 20. The insulating film member 20 is composed of a helical antenna portion 20H and a phase shifter portion 20P. The helical antenna portion 20H has a substantially parallelogram shape while the phase shifter portion 20P has a substantially rectangular shape.

By connecting together a pair of lateral sides SL1 and SL2 of the insulating film member 20 so that the first surface 20-1 becomes an inner peripheral surface, the hollow cylindrical member 11 as shown in FIG. 1 is formed. The connection between the pair of lateral sides is carried out, for example, by the use of double-sided adhesive tape, an adhesive agent, or soldering.

An antenna pattern comprising first to fourth conductors 21, 22, 23, and 24 is formed on the first surface 20-1 of the helical antenna portion 20H. Each of the first to fourth conductors 21 to 24 is formed so as to extend in parallel to the lateral sides of the helical antenna portion 20H in the state where each conductor is bent twice in opposite directions in the longitudinal direction of the pole-type antenna unit 10. Therefore, when the insulating film member 20 is rolled so that the hollow cylindrical member 11 is formed as described above, each of the first to fourth conductors 21 to 24 extends in a helical fashion on the inner peripheral surface of the hollow cylindrical member 11 in the state where each conductor is bent twice in the opposite directions in the longitudinal direction of the pole-type antenna unit 10. The antenna pattern composed of the first to fourth conductors 21 to 24 functions as a helical antenna.

As described above, in this embodiment, the first to fourth conductors 21 to 24 are each bent in the longitudinal direction of the pole-type antenna unit 10 and, therefore, the height of the pole-type antenna unit 10 can be reduced as compared with the case where the conductors are not bent.

A phase shifter pattern 25 electrically connected to the foregoing antenna pattern is formed on the first surface 20-1 of the phase shifter portion 20P. Therefore, when the insulating film member 20 is rolled so that the hollow cylindrical member 11 is formed as described above, the phase shifter pattern 25 is formed on the inner peripheral surface of the hollow cylindrical member 11. This phase shifter pattern 25 functions as a phase shifter.

A ground pattern 27 is formed on the second surface 20-2 of the phase shifter portion 20P. That is, the ground pattern 27 is formed on the surface of the phase shifter portion 20P on the opposite side with respect to the surface thereof where the phase shifter pattern 25 is formed. Therefore, when the insulating film member 20 is rolled so that the hollow cylindrical member 11 is formed as described above, the ground pattern 27 is formed on the outer peripheral surface of the hollow cylindrical member 11 on the opposite side with respect to the surface thereof where the phase shifter pattern 25 is formed. The ground pattern 27 functions as a shield member provided so as to cover the phase shifter pattern 25.

The pole-type antenna unit 10 further comprises a topped hollow cylindrical cover case (cylinder) 40 covering the hollow cylindrical member 11. The inner diameter of the cover case 40 is greater than the diameter of the hollow cylindrical member 11.

As described above, in this embodiment, since the antenna pattern comprising the first to fourth conductors 21 to 24 and forming the helical antenna portion 20H is formed on the inner peripheral surface 20-1 of the hollow cylindrical member 11, there is no direct contact between the antenna pattern and an inner wall of the cover case 40. Therefore, antenna characteristics of the pole-type antenna unit 10 can be prevented from being affected by the cover case 40. Further, since the ground pattern 27 serving as the shield member is disposed on the outer side of the phase shifter pattern 25, the antenna characteristics of the pole-type antenna unit 10 can be prevented from being affected by the human body. As a result, the pole-type antenna unit 10 according to this embodiment can achieve desired antenna characteristics even during use.

In the illustrated embodiment, a first annular cushion member 51 is wound around the outer peripheral surface of the helical antenna portion 20H at its tip end. Further, just below the first annular cushion member 51, a second annular cushion member 52 is wound around the outer peripheral surface of the helical antenna portion 20H. The thickness of the second annular cushion member 52 is slightly greater than a clearance between the hollow cylindrical member 11 and the cover case 40. The first and second annular cushion members 51 and 52 are made of, for example, urethane foam.

By winding the first annular cushion member 51 around the outer peripheral surface of the helical antenna portion 20H at its tip end as described above, it is possible to change permittivity of the helical antenna portion 20H at its tip end, thereby enabling adjustment of antenna frequency characteristics of the pole-type antenna unit 10. Therefore, by changing the thickness or width of the first annular cushion member 51, it is possible to change the antenna frequency characteristics of the pole-type antenna unit 10. At any rate, the first annular cushion member 51 functions as a characteristic adjusting member for adjusting the antenna frequency characteristics of the pole-type antenna unit 10.

On the other hand, the second annular cushion member 52 serves as a cushion between the inner wall of the cover case 40 and the helical antenna portion 20H so that the clearance between the inner wall of the cover case 40 and the helical antenna portion 20H can be maintained constant. Accordingly, since it is possible to prevent an extreme inclination of the helical antenna portion 20H with respect to the cover case 40, variation in directivity of the pole-type antenna unit 10 can be suppressed. As described above, since the thickness of the second annular cushion member 52 is slightly greater than the clearance between the helical antenna portion 20H and the inner wall of the cover case 40, the second annular cushion member 52 is press-fitted into the cover case 40. As a result, the distance between the inner wall of the cover case 40 and the helical antenna portion 20H can be held constant. At any rate, the second annular cushion member 52 functions as a distance holding member for holding constant the distance between the hollow cylindrical member 11 and the inner wall of the cover case 40.

The pole-type antenna unit 10 comprises a board 32, such as a printed circuit board. An electronic component such as a low-noise amplifier (LNA), which will be described later, is mounted on the board 32. The low-noise amplifier is connected to an output terminal 25*a* of the phase shifter pattern 25 and one end of the cable 31.

A satellite wave (circularly polarized wave) is received by the four conductors 21 to 24 of the helical antenna portion 20H as four received waves. The four received waves are phase-shifted by the phase shifter pattern 25 so as to be matched (adjusted) in phase, thereby obtaining a combined wave. Then, the combined wave is amplified by the low-noise amplifier and sent to a receiver unit (not shown) through the cable 31.

Figure 3:
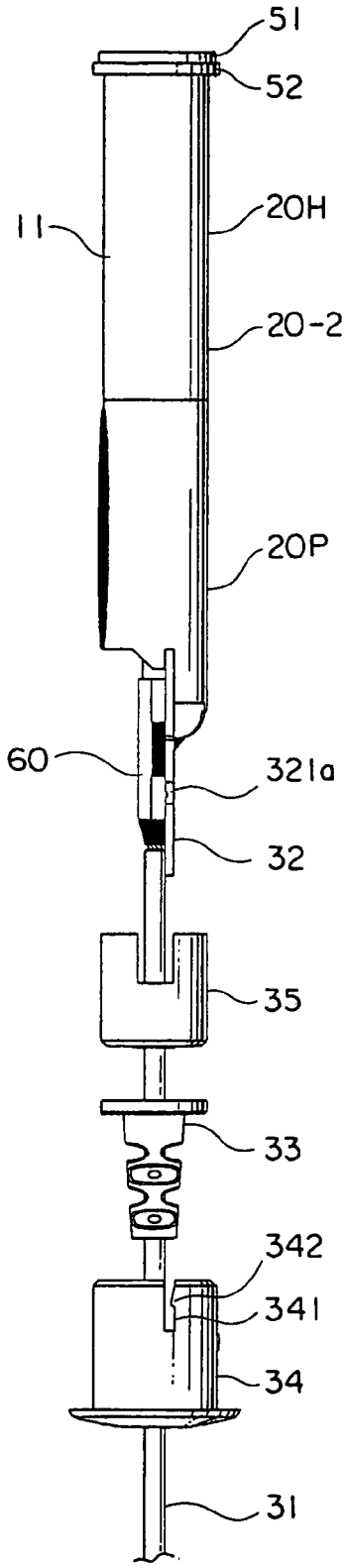
FIG. 3 is an exploded rear view showing the pole-type antenna unit illustrated in FIG. 1 with a cover case removed.
Figure 4:
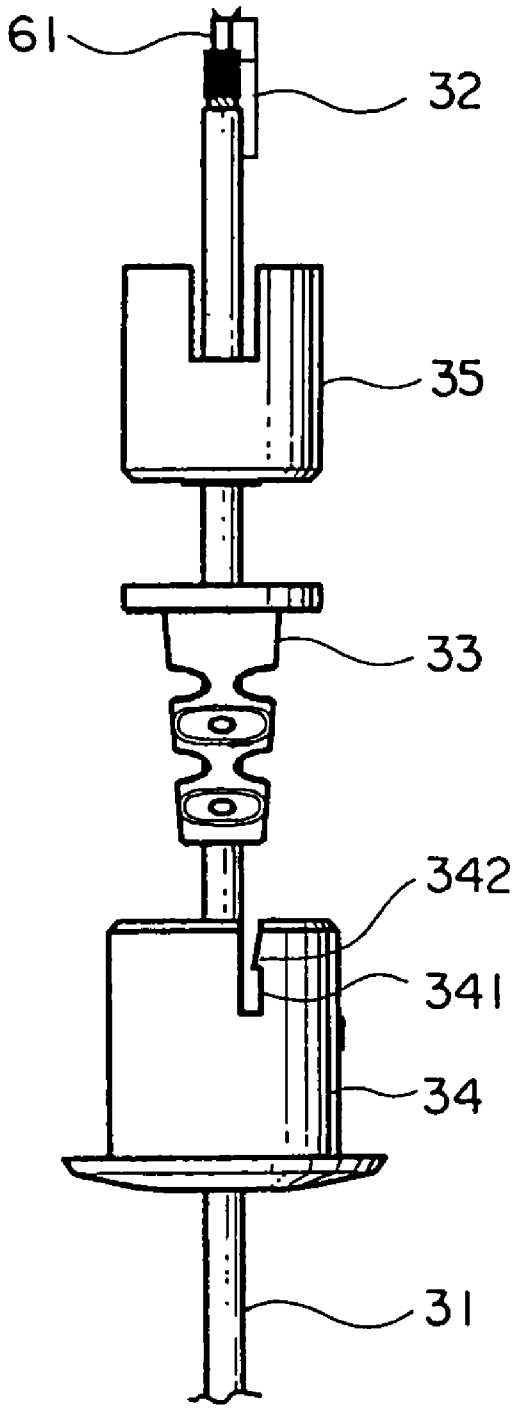
FIG. 4 is an exploded rear view showing the pole-type antenna unit illustrated in FIG. 3 with a hollow cylindrical member removed.
Figure 5:
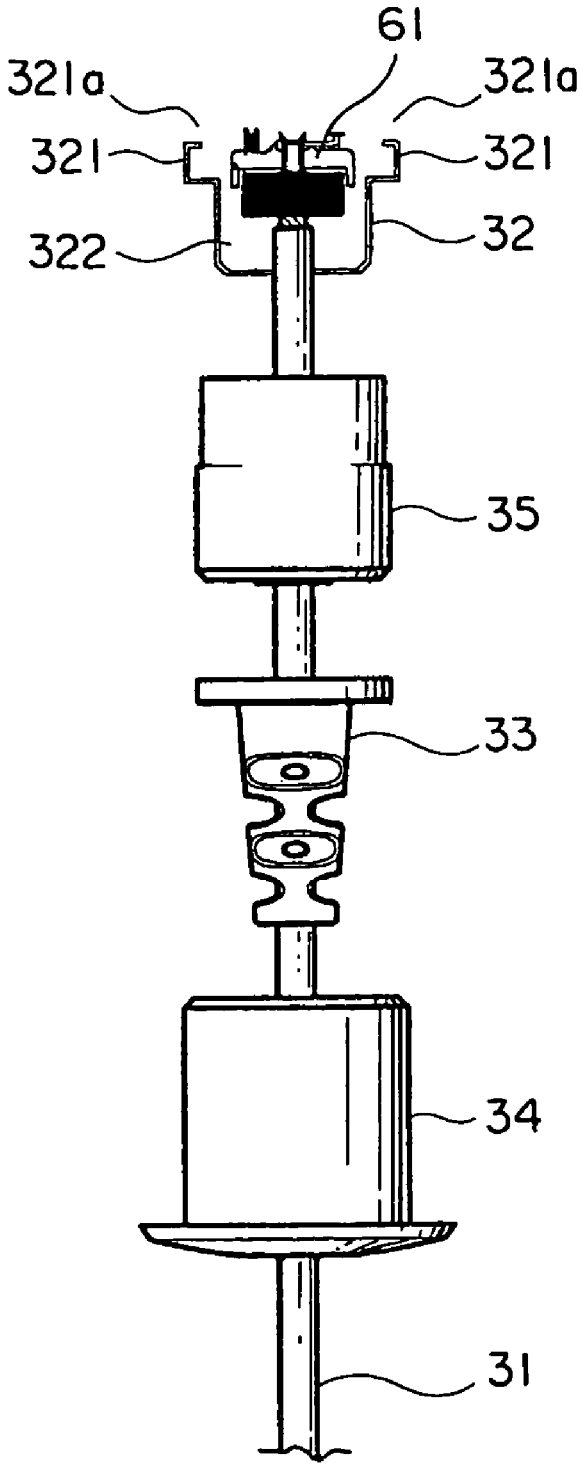
FIG. 5 is an exploded side view of the pole-type antenna unit illustrated in FIG. 4.

Referring also to FIGS. 3 to 5 in addition to FIG. 1, the pole-type antenna unit 10 further comprises a boot 33 slidably attached to the cable 31, an undercap (bottom cover) 34 that is attached to a lower end of the cover case 40 as will be described later, and a waterproof packing 35. The boot 33 is made of polyurethane.

By disopsing the boot 33 and the packing 35 in the undercap 34 and inserting the board 32 therein, there are provided a waterproof function on the cable 31 and a board fixing function.

Figure 6:
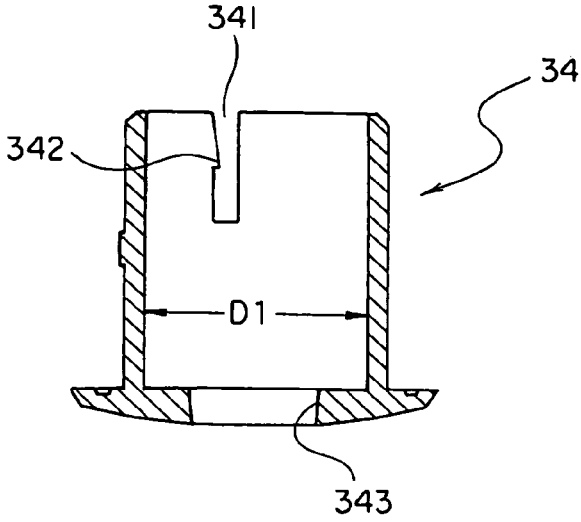
FIG. 6 is a sectional view of an undercap used in the pole-type antenna unit illustrated in FIG. 1.

FIG. 6 is a sectional view of the undercap 34. As shown in FIG. 6, the undercap 34 is formed with a pair of cutouts 341 on its upper end side for receiving therein both side end portions 321 (FIG. 5) of the board 32. The undercap 34 is provided with a pawl 342 at each of the cutouts 341 in order to prevent the board 32 from returning back upon press-fitting thereof. Further, the undercap 34 is formed at its lower end with an opening 343 in which the boot 33 is inserted.

As described above, the board 32 has the side end portions 321 projecting laterally from its both side surfaces. As shown in FIG. 3, each side end portion 321 of the board 32 is formed with a cutout 321*a* for engagement with the corresponding pawl 342 of the undercap 34.

Figure 7A:
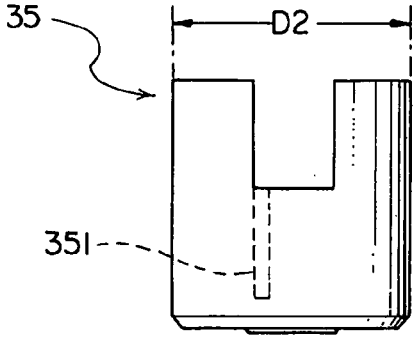
Figure 7B:
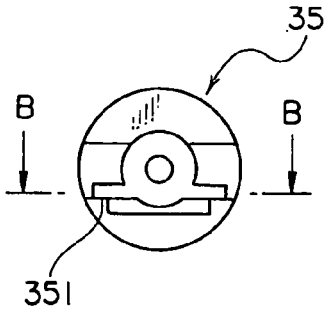
Figure 7C:
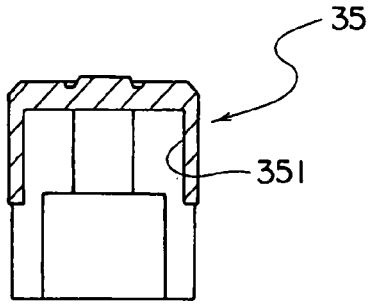

FIGS. 7A, 7B, and 7C are diagrams showing the packing 35, wherein FIG. 7A is a front view, FIG. 7B is a plan view, and FIG. 7C is a sectional view taken along line B-B in FIG. 7B. As shown in FIGS. 6 and 7A, an outer diameter D2 of the packing 35 is slightly greater than an inner diameter D1 of the undercap 34. This is for press-fitting the packing 35 into the undercap 34. The packing 35 is formed with a cutout 351 in which a lower end portion 322 (FIG. 5) of the board 32 is inserted.

By press-fitting the packing 35 into the undercap 34 and fixing such a press-fitted state by the board 32, the waterproof function on the cable 31 is realized. In this event, since the board 32 is also fixed in the undercap 34, positioning of the board 32 can also be carried out.

Figure 8:
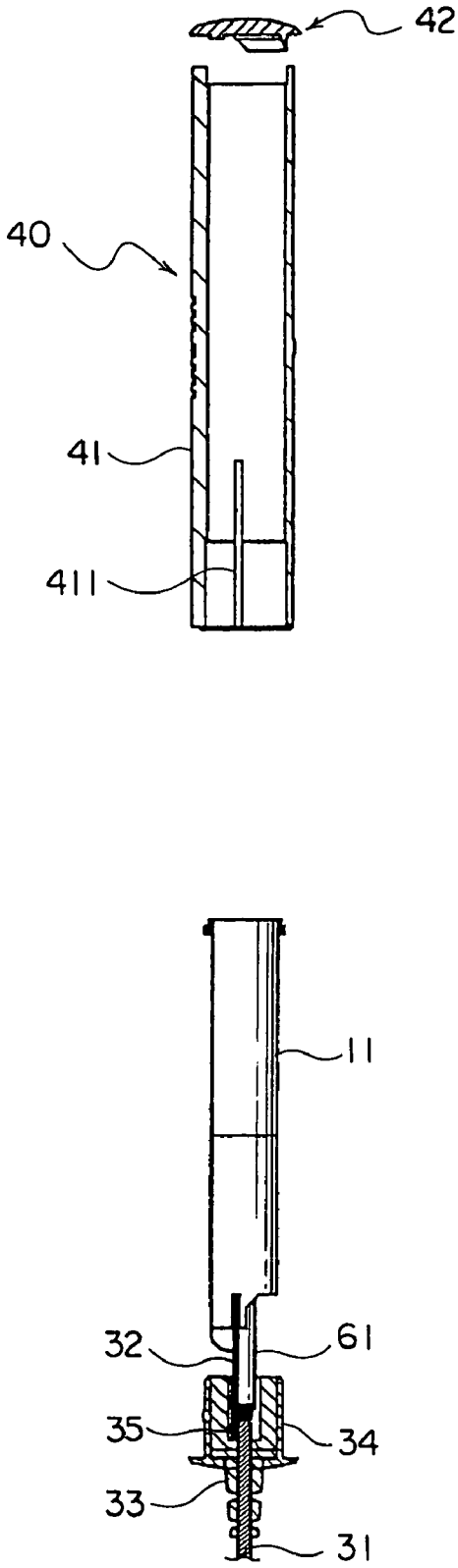
FIG. 8 is an exploded front sectional view of the pole-type antenna unit illustrated in FIG. 1.

Referring to FIG. 8, the cover case 40 comprises a cylinder portion 41 and a top cover 42. The cylinder portion 41 is formed on its inner wall with a pair of grooves 411 for receiving therein the side end portions 321 of the board 32.

Figure 9:
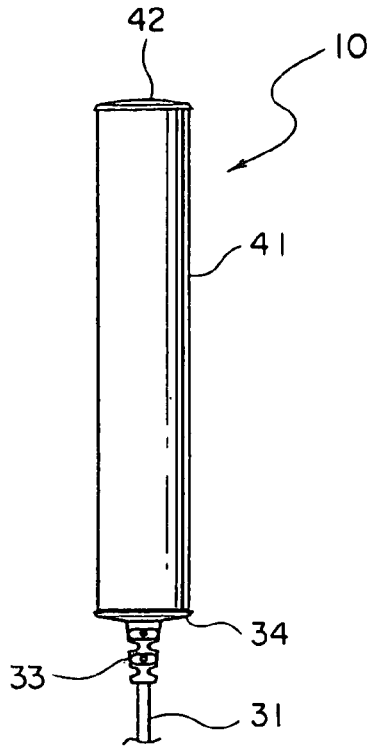
FIG. 9 is a front view showing the external appearance of the pole-type antenna unit illustrated in FIG. 1.
Figure 10:
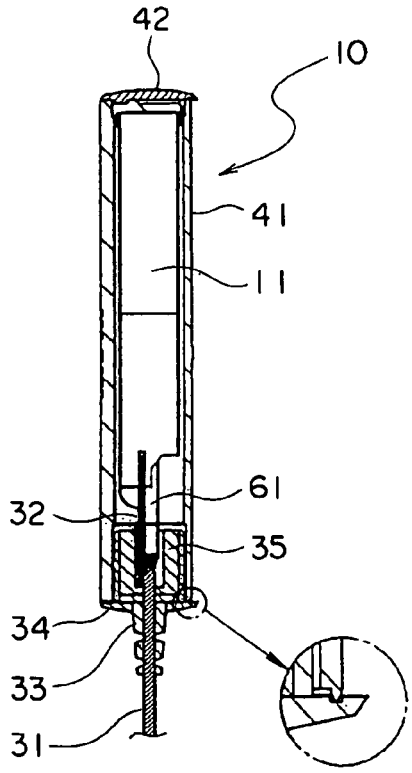
FIG. 10 is a front sectional view of the pole-type antenna unit illustrated in FIG. 1.
Figure 11:
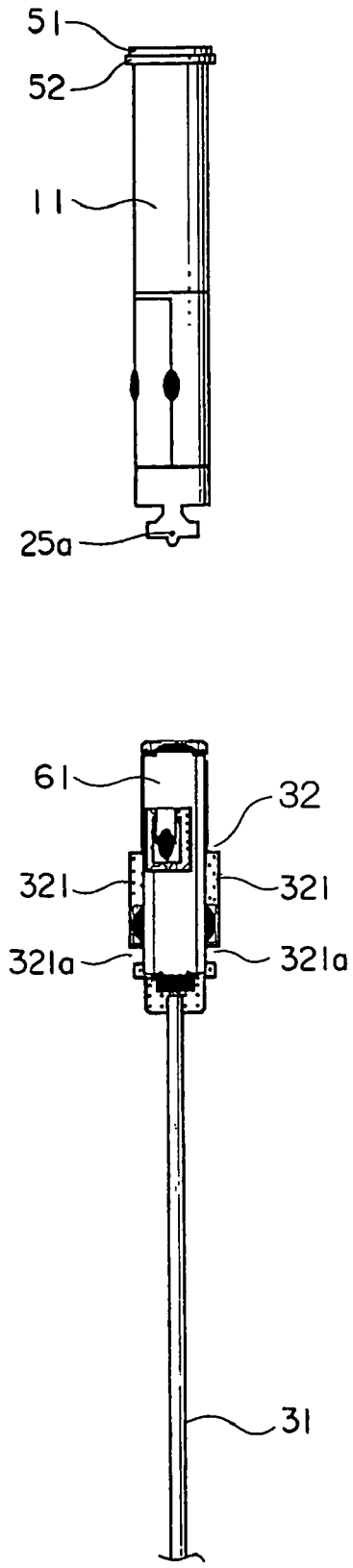
FIG. 11 is an exploded side view for explaining a positional relationship between a board and the hollow cylindrical member used in the pole-type antenna unit illustrated in FIG. 1.
Figure 12:
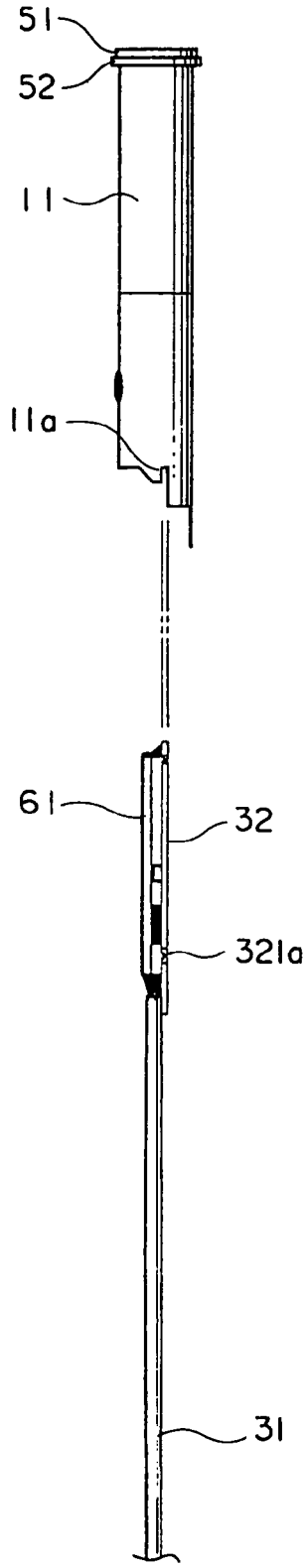
FIG. 12 is an exploded rear view for explaining the positional relationship between the board and the hollow cylindrical member illustrated in FIG. 11.

FIG. 9 is a front view showing the external appearance of the pole-type antenna unit 10 and FIG. 10 is a sectional view of the pole-type antenna unit 10. The top cover 42 is bonded to an upper end of the cylinder portion 41 by ultrasonic bonding. The undercap (bottom cover) 34 is bonded to a lower end of the cylinder portion 41 by ultrasonic bonding. Since, as described above, the pole-type antenna unit 10 has the structure using no screws, it is possible to reduce the number of components.

Referring to FIGS. 11 to 14, description will be made about a positional relationship between the board 32 and the hollow cylindrical member 11. The hollow cylindrical member 11 has a pair of cutouts 11*a* for receiving therein the side end portions 321 of the board 32.

Figure 13:
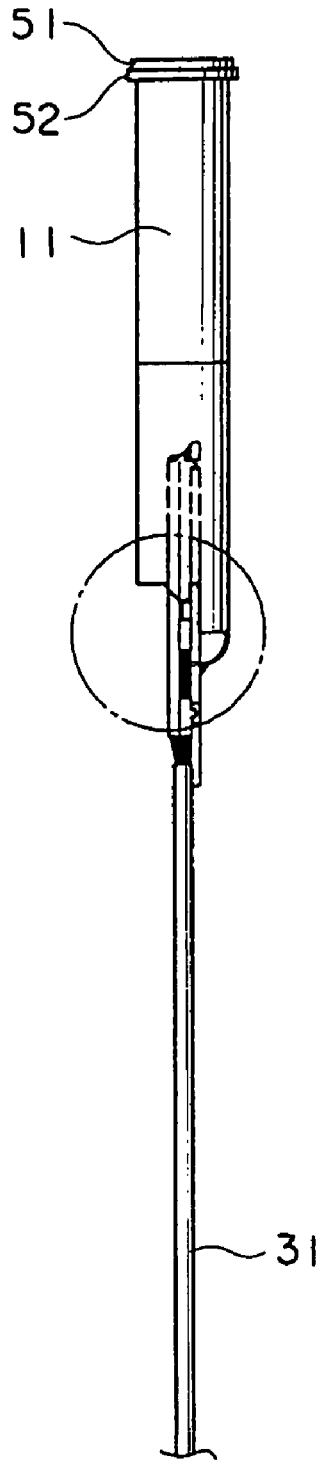
FIG. 13 is a rear view showing the state where the board and the hollow cylindrical member illustrated in FIG. 11 are assembled together.
Figure 14:
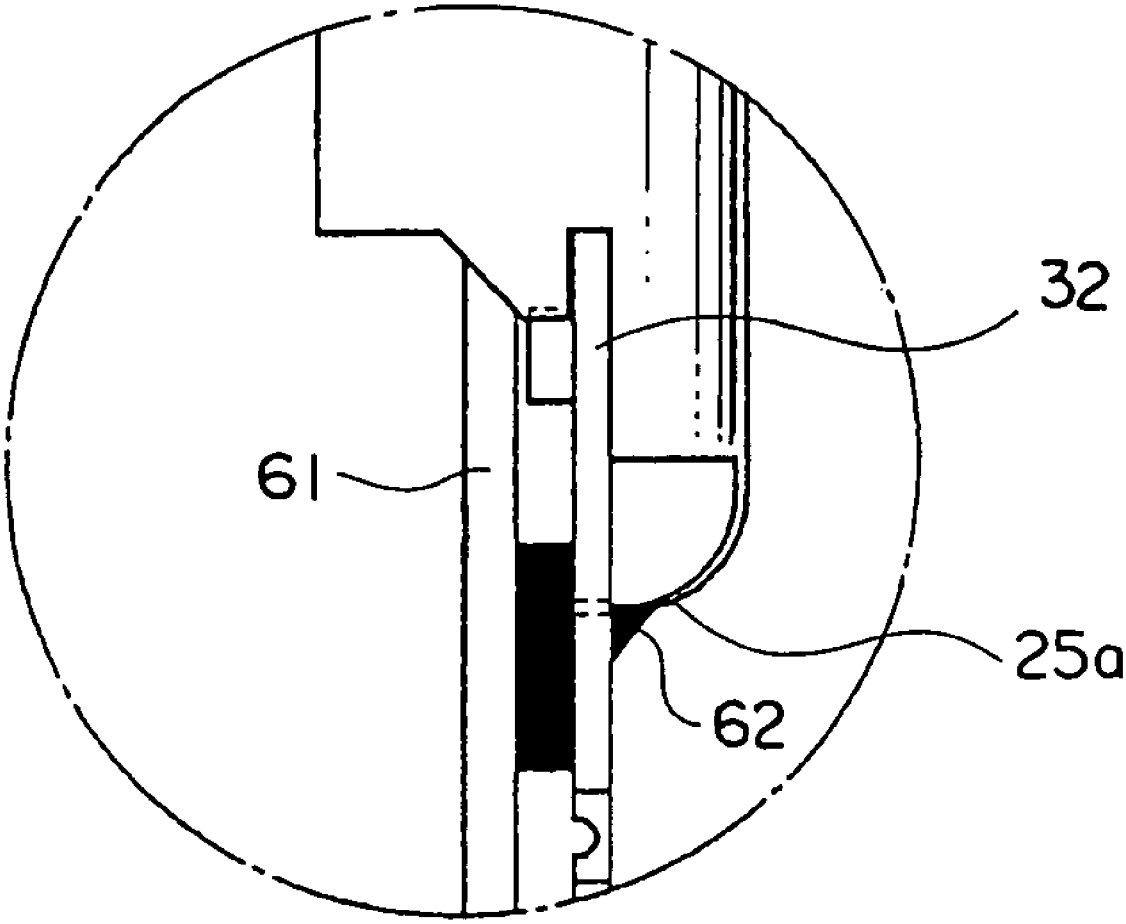
FIG. 14 is an enlarged view of an encircled portion in FIG. 13.

As shown in FIG. 13, part of the board 32 mounted with a low-noise amplifier (LNA) 61 (FIG. 11) is inserted into the inside of the hollow cylindrical member 11. As shown in FIG. 14, the output terminal 25*a* of the hollow cylindrical member 11 is connected to the board 32 (low-noise amplifier 61) by solder 62.

Since the part of the board 32 is inserted into the inside of the hollow cylindrical member 11 as described above, it is possible to reduce the size of the pole-type antenna unit 10 in its longitudinal direction. Further, since the connection between the hollow cylindrical member 11 and the board 32 (low-noise amplifier 61) is carried out by the use of the output terminal 25*a* formed at the flexible insulating film member 20, the particular or dedicated terminal component required in the conventional pole-type antenna unit becomes unnecessary and, therefore, it is possible to reduce the number of components.

Figure 15:
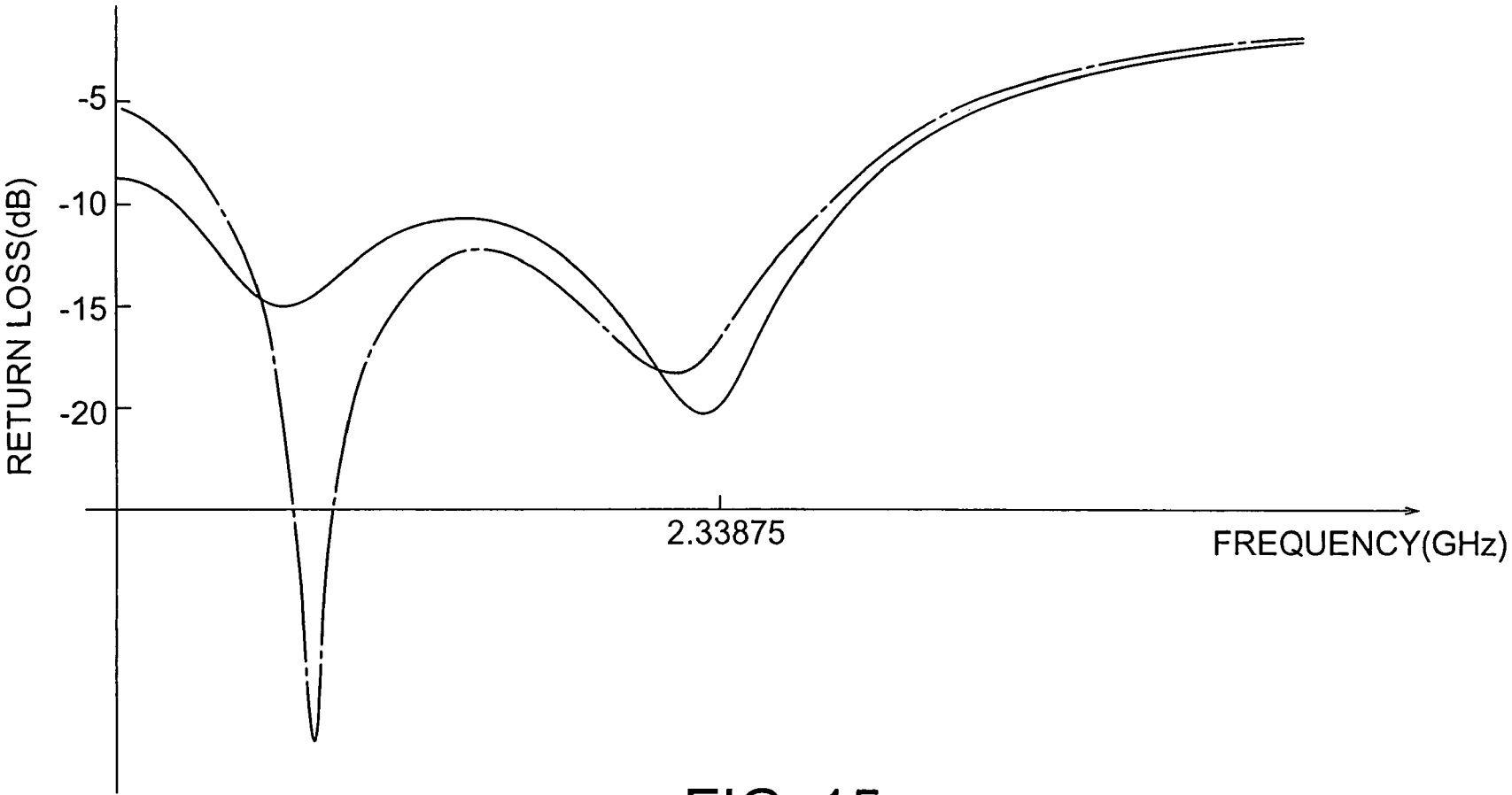
FIG. 15 is a diagram showing return loss characteristics of the pole-type antenna unit with first and second annular cushion members illustrated in FIG. 1 and a conventional pole-type antenna unit without the first and second annular cushion members.

FIG. 15 shows return loss characteristics of the pole-type antenna unit 10 according to this invention (i.e. with the first and second annular cushion members 51 and 52) and a conventional pole-type antenna unit (i.e. without the first and second annular cushion members 51 and 52). In FIG. 15, the axis of abscissas represents frequency (GHz) and the axis of ordinates represents return loss (dB). In FIG. 15, a continuous line shows the return loss characteristics of the pole-type antenna unit 10 according to this invention, while a chain line shows the return loss characteristics of the conventional pole-type antenna unit.

At a center frequency (2.33875 GHz), a return loss of the pole-type antenna unit 10 according to this invention is −19.685 dB while a return loss of the conventional pole-type antenna unit is −16.398 dB. Therefore, it is understood that the return loss characteristics of the pole-type antenna unit 10 according to this invention have been improved.

While this invention has been described in terms of the preferred embodiment, the invention is of course not limited thereto. For example, in the embodiment, the four conductors formed on the inner peripheral surface of the hollow cylindrical member are used as the antenna pattern. However, the antenna pattern may be composed of at least one conductor. In the case of the single conductor, the phase shifter (phase shifter portion) is not required. In the embodiment, the antenna pattern and the phase shifter pattern are formed on the inner peripheral surface of the hollow cylindrical member. However, the antenna pattern and the phase shifter pattern may be formed on the outer peripheral surface of the hollow cylindrical member. In the embodiment, the annular cushion member wound around the outer peripheral surface of the hollow cylindrical member at its tip end is used as the characteristic adjusting member. However, the characteristic adjusting member is of course not limited thereto. Further, in the embodiment, the annular cushion member wound around the outer peripheral surface of the portion, where the antenna pattern is formed, of the hollow cylindrical member in the vicinity of its tip end is used as the distance holding member. However, use may be made of an annular cushion member wound around the outer peripheral surface of the portion, where the phase shifter pattern is formed, of the hollow cylindrical member, or the hollow cylindrical member may be fixed by the use of the cover case (cylinder) itself. Further, in the embodiment, the two kinds of annular cushion members are used as the characteristic adjusting member and the distance holding member. However, unless there is a problem in terms of structure, a single kind of annular cushion member may be used instead of them to realize those functions.

The pole-type antenna unit described in the embodiment is suitable as a personal-type miniature antenna unit for a digital radio receiver, but not limited thereto, and is also applicable as an antenna unit for a GPS receiver or an antenna unit for mobile communication adapted to receive other satellite waves or ground waves.

Since the antenna unit according to this invention is provided with the characteristic adjusting member, the effect is obtained that the antenna frequency characteristics can be adjusted. Further, by providing the distance holding member that serves to hold constant the distance between the hollow cylindrical member and the inner wall of the cover case, the effect is obtained that variation in antenna directivity can be suppressed. As a result, it is possible to stabilize the antenna characteristics of the antenna unit.

What is claimed is:

1. An antenna unit comprising:

a hollow cylindrical member comprising a flexible insulating film member formed into a hollow cylinder;

an antenna pattern comprising at least one conductor provided on said hollow cylindrical member;

a hollow cylindrical cover case which covers said hollow cylindrical member;

a characteristic adjusting member which adjusts an antenna frequency characteristic; and a distance holding member which is attached to an outer peripheral surface of said hollow cylindrical member, and which holds a constant distance between said hollow cylindrical member and an inner wall of said cover case.

2. An antenna unit according to claim 1, wherein said characteristic adjusting member comprises an annular cushion member wound around the outer peripheral surface of said hollow cylindrical member at a tip end thereof.

3. An antenna unit according to claim 1, wherein said distance holding member comprises an annular cushion member wound around the outer peripheral surface of said hollow cylindrical member at a predetermined portion thereof.

4. An antenna unit according to claim 3, wherein said annular cushion member is provided in a vicinity of a tip end of said hollow cylindrical member.

5. An antenna unit according to claim 3, wherein a thickness of said annular cushion member is slightly greater than the constant distance between said hollow cylindrical member and the inner wall of said cover case.

6. An antenna unit comprising:

a hollow cylindrical member comprising a flexible insulating film member formed into a hollow cylinder;

an antenna pattern comprising a plurality of conductors provided on said hollow cylindrical member;

a phase shifter pattern provided on said hollow cylindrical member so as to be electrically connected to said antenna pattern;

a hollow cylindrical cover case which covers said hollow cylindrical member;

a characteristic adjusting member which adjusts an antenna frequency characteristic; and a distance holding member which is attached to an outer peripheral surface of said hollow cylindrical member, and which holds a constant distance between said hollow cylindrical member and an inner wall of said cover case.

7. An antenna unit according to claim 6, wherein said characteristic adjusting member comprises an annular cushion member wound around the outer peripheral surface of said hollow cylindrical member at a tip end thereof.

8. An antenna unit according to claim 6, wherein said distance holding member comprises an annular cushion member wound around the outer peripheral surface of said hollow cylindrical member at a predetermined portion thereof.

9. An antenna unit according to claim 8, wherein said annular cushion member and said antenna pattern are provided in a vicinity of a tip end of said hollow cylindrical member.

10. An antenna unit according to claim 8, wherein said predetermined portion is a portion of said hollow cylindrical member where said phase shifter pattern is formed.

11. An antenna unit according to claim 8, wherein a thickness of said annular cushion member is slightly greater than the constant distance between said hollow cylindrical member and the inner wall of said cover case.

* * * * *